US006190138B1

(12) United States Patent
Hugenroth et al.

(10) Patent No.: US 6,190,138 B1
(45) Date of Patent: Feb. 20, 2001

(54) FLOW VALVE FOR CORRECTING REVERSE ROTATION IN SCROLL COMPRESSOR

(75) Inventors: Jason J. Hugenroth; Charles A. Stead; Thomas R. Barito, all of Arkadelphia, AR (US)

(73) Assignee: Scroll Technologies, Arkadelphia, AR (US)

( * ) Notice: Under 35 U.S.C. 154(b), the term of this patent shall be extended for 0 days.

(21) Appl. No.: 09/094,970

(22) Filed: Jun. 12, 1998

(51) Int. Cl.[7] ..... F04B 49/00
(52) U.S. Cl. ..... 417/310; 417/440
(58) Field of Search ..... 417/301, 310, 417/309, 440

(56) References Cited

U.S. PATENT DOCUMENTS 4,840,545 * 6/1989 Moilanen ..... 417/301
5,088,905 * 2/1992 Beagle ..... 418/55.1
5,169,294 * 12/1992 Barito ..... 417/310
5,362,210 * 11/1994 Richardson, Jr. ..... 417/310 X
5,591,014 * 1/1997 Wallis et al. ..... 417/310
5,807,081 * 9/1998 Schutte et al. ..... 417/309
5,947,701 * 9/1999 Hugenroth ..... 417/310

* cited by examiner

*Primary Examiner*—Timothy S. Thorpe
*Assistant Examiner*—David J. Torrente
(74) *Attorney, Agent, or Firm*—Carlson, Gaskey & Olds

(57) ABSTRACT

A scroll compressor has a valve normally closed during forward operation of the scroll compressor. Upon reverse rotation, force imbalances allow the valve to open and communicate a chamber downstream of a check valve to a chamber upstream of the check valve. By communicating these two chambers, the detrimental effects of reverse rotation are reduced or eliminated. Two valve embodiments are disclosed. One embodiment also relieves unduly high discharge pressures. In a third embodiment, a pressure relief valve is provided to prevent desirably high pressure ratios or pressure differentials.

14 Claims, 3 Drawing Sheets

FLOW VALVE FOR CORRECTING REVERSE ROTATION IN SCROLL COMPRESSOR

BACKGROUND OF THE INVENTION

This invention relates to a valve which opens upon reverse rotation of a scroll compressor to communicate gas downstream of a check valve to a location upstream of the check valve.

Scroll compressors are quite efficient, and thus are becoming more and more widely utilized in refrigerant compression applications. In general, a scroll compressor consists of a orbiting scroll having a base with a generally spiral wrap extending from the base, and a non-orbiting scroll having a base and a wrap extending from its base. The wraps of the orbiting and non-orbiting scrolls interfit to define gas pockets. As the orbiting scroll orbits relative to the non-orbiting scroll, the size of the pocket changes and an entrapped gas is compressed. Scroll compressors are designed to have the orbiting scroll orbit in one direction relative the non-orbiting scroll.

To this end, a motor for driving the orbiting scroll is connected to the orbiting scroll through a mechanical connection which changes the rotation of a motor into orbiting movement of the orbiting scroll. Frequently, the motor is provided with a three phase power supply.

If the three phase power supply is miswired, the motor may run in reverse. If the motor runs in reverse, the orbiting scroll orbits in the reverse direction relative to the non-orbiting scroll. The fluid is no longer compressed, and the systems may heat to undesirable temperatures. In addition, unwanted noise occurs.

This problem is typically encountered with a miswired three phase power supply. However, the problem can also occur with a single phase power supply where there is an intermittent shutdown. An entrapped gas can begin to drive the orbiting scroll in the wrong direction, and when the motor is again started, reverse rotation may continue.

One other concern with scroll compressors is that in some instances, the pressure differential or pressure ratio will become undesirably high. When this occurs, the discharge pressure will become correspondingly high. The prior art has addressed this problem by including separate pressure relief valves, or sensors which sense the results of the high pressure ratio or pressure differential and control the compressor accordingly. The requirement of adding in these additional valves or sensors is undesirably expensive.

It is the object of this invention to address the problem of reverse rotation, and provide a valve which reduces any harmful effects from reverse rotation.

SUMMARY OF THE INVENTION

In a disclosed embodiment of this invention, a valve is normally closed during forward rotation of the motor. Upon reverse rotation, the valve opens and communicates a chamber downstream of a check valve to another chamber upstream of the check valve. By communicating these chambers, the harmful effects of the reverse rotation will be greatly reduced.

In one embodiment, the valve is positioned in a separator plate, and includes a valve with discharge pressure from a chamber slightly upstream of the check valve on one face biasing it to a closed position. Suction pressure is exposed to an opposed face. During normal operation, discharge pressure greatly exceeds suction pressure and biases the valve to a closed position.

However, upon reverse rotation, the discharge pressure upstream of the check valve becomes low compared to the suction pressure. The suction pressure is thus able to move the valve to an open position. The pressure downstream of the check valve is thus able to move upstream of the check valve. This thus reduces the noise and heat generated during reverse rotation.

In a second embodiment, a valve assembly is mounted between a separator plate and an intermediate compression chamber in the scroll pump unit. The valve assembly has a first valve member normally spring biased to a closed position closing a tap to a chamber downstream of a check valve. The first valve also "sees" suction pressure on a top surface of the valve, and an intermediate pressure beneath the valve. A spring biases the valve to the closed position. A second valve moves within the first valve and is held at a closed position within the first valve because intermediate pressure exceeds the suction pressure during normal operation. Thus, during normal operation, the valve assembly is maintained closed and there is no communication between the chamber downstream of the check valve and the intermediate pressure chamber.

However, during reverse rotation, the pressure downstream of the check valve approximates the suction pressure. Both pressures exceed intermediate pressure. The first valve is driven against the spring force to an open position. This allows fluid from the downstream chamber to move through an opening in the first valve and drive the second valve to an open position. The pressure downstream of the check valve now moves through the valve assembly and communicates into the intermediate chamber. This reduces any harmful effects from reverse rotation.

At the same time, once the first check valve is open, the pressure within a chamber that had previously been communicated to the suction pressure drops to the low intermediate pressure level. A third valve, which controls a tap to suction pressure, quickly closes. In this way, upon the occurrence of a reverse rotation, the system pressure downstream of this check valve is quickly communicated into the intermediate pressure chamber, thus reducing any noise or overheating due to the reverse rotation.

This second embodiment also opens to communicate the pressure downstream to the suction chamber when there is a pressure ratio or pressure differential that is too high. Under these circumstances the discharge pressure is high and exceeds the spring and pressure forces holding the valve closed. Thus, the valve opens to relieve the high pressure. This valve operates to balance the intermediate pressure against the discharge pressure and the suction pressure, and should the discharge pressure increase to such an extent that it is indicative of an undesirably high pressure ratio or pressure differential, then the valve will move to an open position, and the discharge pressure chamber is communicated back to a suction pressure chamber. A third valve solely provides this function. The third value and the same feature of the second value, eliminates the need for pressure relief valves, or thermal relief valves, as may typically be incorporated into current production scroll compressors.

These and other features of the present invention can be best understood from the following specification and drawings, the following of which is a brief description.

DETAILED DESCRIPTION OF A PREFERRED EMBODIMENT

Figure 1:
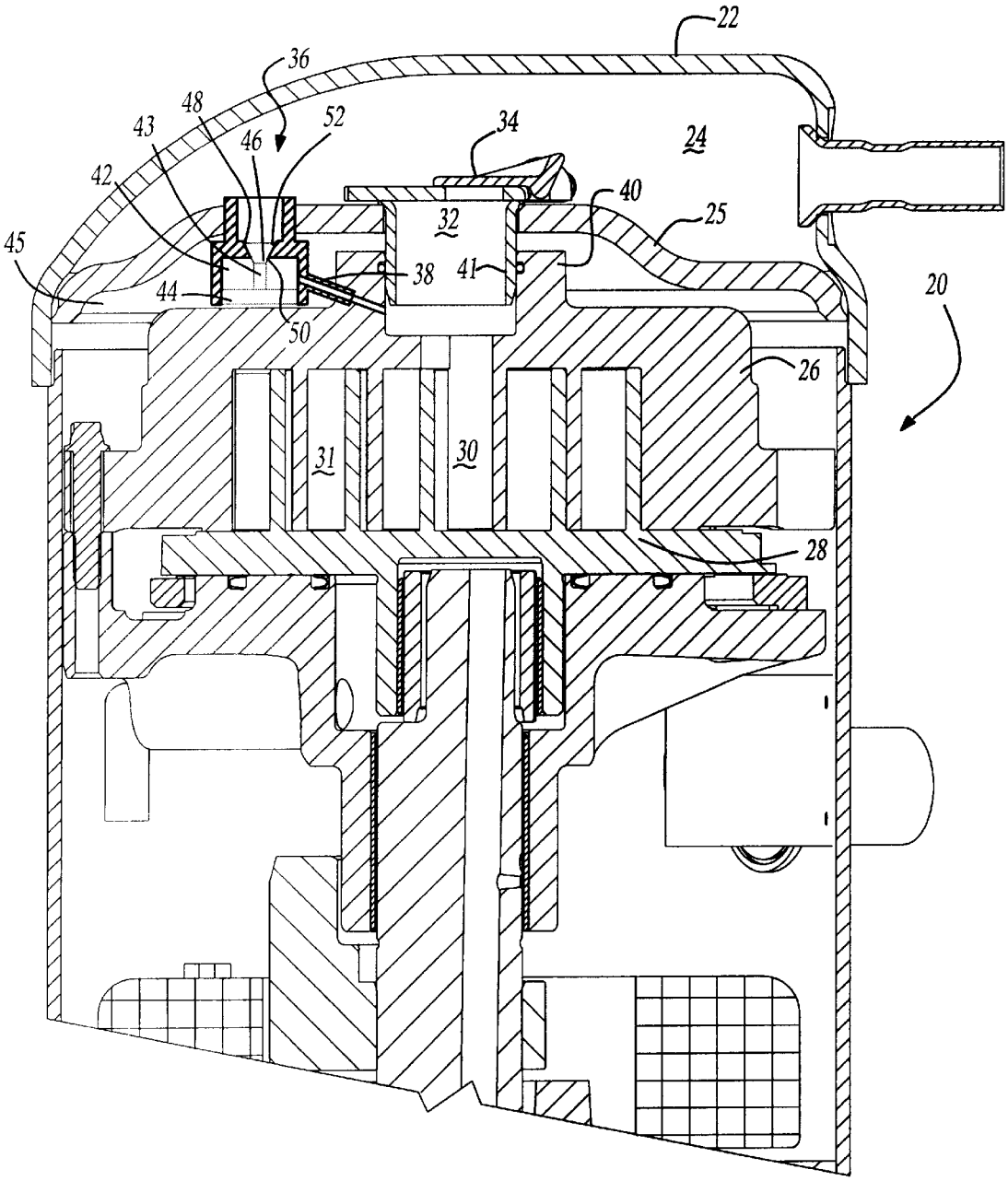
FIG. 1 shows a first embodiment valve according to this invention in a closed position.

A scroll compressor 20 is shown in FIG. 1 having an outer housing 22 defining a system plenum chamber 24 which receives the discharge pressure gas. A separator plate 25 is positioned beneath chamber 24, and above a non-orbiting scroll member 26. Orbiting scroll 28 has wraps which interfit with wraps from non-orbiting scroll 26 to define a discharge chamber 30, and other pressure chambers such as an intermediate pressure chamber 31. Discharge chamber 32 outwardly of the non-orbiting scroll 26 communicates with discharge chamber 30. A check valve 34 closes discharge chamber 32 from the chamber 24. During normal operation, the check valve 34 is open and compressed gas can flow from chambers 30 and 32 into chamber 24, and then to a downstream use of the compressed gas.

A reverse flow protection valve 36 incorporates a passage 38 which selectively communicates gas from downstream chamber 24 into discharge chamber 32 when reverse rotation occurs. This will reduce harmful effects from reverse rotation. As shown, a boss 40 extends upwardly from the rear face of the non-orbiting scroll 26 to receive a discharge tube 41.

A valve chamber 42 is defined within a valve body, and receives a valve 43 including an enlarged land 44 connected to a stem 46 which is in turn connected to a valve member 48. A lower face of land 44 is exposed to suction pressure in chamber 45. An upper face of land 44 sees discharge pressure from chamber 32. Valve 48 has a frusto-conical surface 50 selectively received within a valve seat 52 to close flow between chamber 24, and chamber 42, passage 38, and eventually chamber 32.

During normal operation of the scroll compressor, the pressure in chambers 24 and 32 greatly exceeds the pressure in chamber 45, which is suction pressure. Thus, valve 48 is held closed.

Thus, as orbiting scroll 28 orbits relative to the non-orbiting scroll 26, and gas in a forward direction is compressed and passed through chambers 30, 32 to chamber 24.

Figure 2:
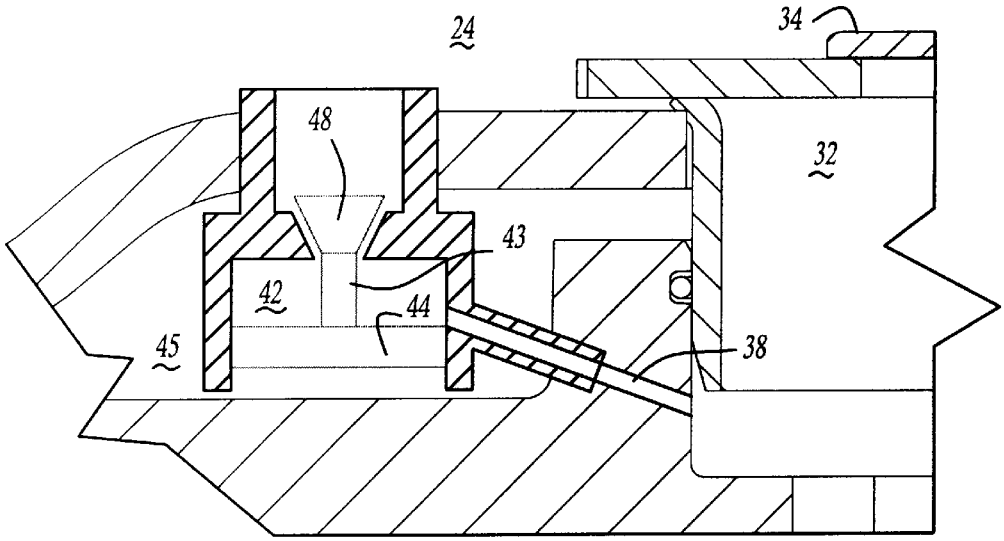
FIG. 2 shows the FIG. 1 valve in an open position.

As shown in FIG. 2, when reverses rotation occurs, the pressure in chamber 32 will drop rapidly. The pressure in chamber 24 will approximate the pressure in chamber 45. Thus, there is a relatively low pressure in the chamber 42 above the land 44, and a relatively high pressure in the chamber 45 below the land 44. Valve 43 is driven upwardly to the position shown in FIG. 2. Gas can flow from chamber 24 around valve 48 through an opening between seat 52, into opening 38 and into chamber 32. The very low pressure which was previously generated below the check valve 34 by reverse rotation will now be relieved. A good deal of the noise and detrimental heat generated during reverse rotation will be reduced by this flow of gas.

Figure 3:
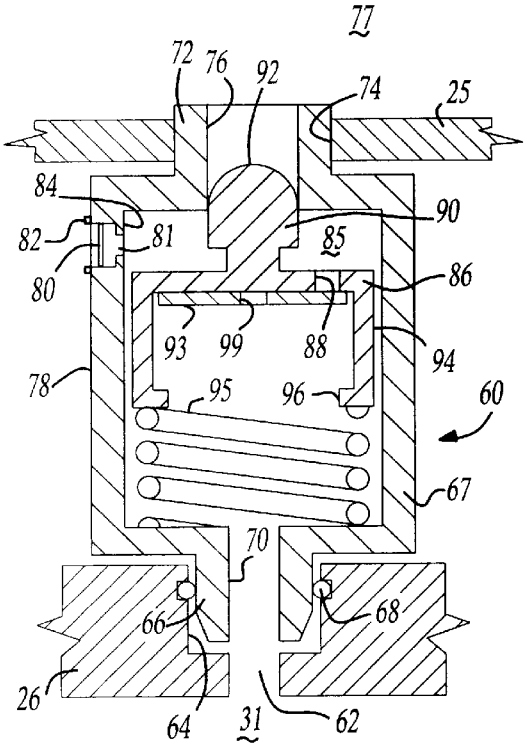
FIG. 3 shows a second embodiment valve in the closed position.

FIG. 3 shows a second embodiment 60 with tap 62 extending through the non-orbiting scroll 26 to the intermediate pressure chamber 31. An opening 64 receives inner portion 66 of a valve body 67 and a seal 68. An opening 70 extends through the valve body 67 to communicate with tap 62.

An upper portion 72 of the valve body 67 is received within an opening 74 in a separator plate 25. An opening 76 extends through the portion 72 and communicates with a chamber 77 downstream of the check valve. A cylindrical portion 78 of valve body 67, receives valve 80 in an opening 81 in a side of portion 78. A clip 82 prevents valve 80 from moving outwardly of the cylindrical body 78. An inner tab 84 prevents valve 80 from moving too far inwardly into a chamber 85 defined above valve 86. An opening 88 is formed through valve 86. A closure portion 90 has an upper surface 92 closing passage 76.

A side portion 94 of the valve body 86 has inner ends 96 to capture a valve 93. A spring 95 biases valve body 86 to the closed position shown in FIG. 3. During forward rotation, the intermediate pressure 31 is received on the bottom of valve 93, and the bottom of valve 86. Suction pressure moves through opening 81 to a chamber 85 on the top surface of valve 86. System pressure, which is roughly equivalent to the discharge pressure during forward operation, is exposed to an upper surface 92 of the closure portion 90. Thus, there is a force from the discharge pressure on surface 92 and suction pressure on surface 86 forcing the valve body 86 downwardly. There is an opposed force from the spring 95, and the intermediate pressure on the valve 93 forcing the valve upwardly. During normal operation of the system, the valve 93 will be kept closed since the intermediate pressure will exceed the suction pressure. In addition, the valve body 86 will be kept in the closed position with portion 90 closing passage 76 since the spring force is selected such that when combined with the intermediate pressure it exceeds the combined forces of the suction and discharge pressure on their respective areas. Preferably the area exposed to suction pressure plus the area exposed to discharge pressure is approximately equal to the area exposed to intermediate pressure.

Figure 4:
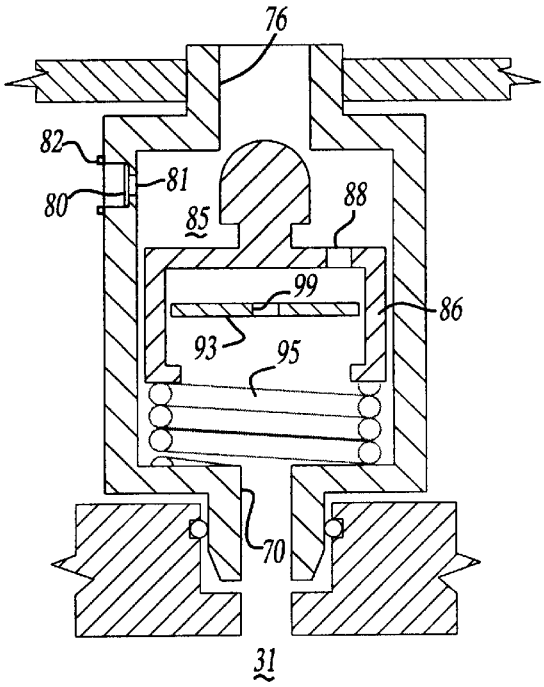
FIG. 4 shows a second embodiment valve in the open position.

However, during reverse rotation, the intermediate pressure drops dramatically relative to the suction and discharge pressures. The pressure at opening 76 is system pressure downstream of the check valve. During reverse rotation, this pressure is approximately equal to the suction pressure seen through opening 81. The combined forces will now exceed the spring force and the force from the intermediate pressure, since the intermediate pressure will be greatly reduced. The valve body 86 moves downwardly as shown in FIG. 4 such that opening 76 opens. At that point, system pressure is exposed to the top of valve 93, with very low pressure in chamber 31 below the valve. Valve 93 opens and the pressure from the chamber 77 moves through opening 88, opening 99, into opening 70, and into the intermediate pressure chamber 31. This will reduce any detrimental effects from reverse rotation.

At the same time, once valve 93 opens, there will be a very low pressure from the intermediate pressure chamber in the chamber 85 above the valve 86. Valve 80 then rapidly closes opening 81. In this way, suction pressure is maintained in the suction chamber, and a pressure which approximates suction pressure is communicated into the intermediate pressure chamber 31. The forces will be balanced, and there will be reduced detrimental effect from the reverse rotation.

In addition, should there be unusually high pressure ratio or pressure differential in the scroll compressor, the pressure in chamber 77 will exceed the normal design discharge pressure. At some point, the pressure in chamber 77 multiplied by the area over which it is applied plus the pressure in the suction chamber 85 multiplied over the area to which it is applied will exceed the force from intermediate chamber 31 over its area plus the force of spring 95. This will occur when either the pressure ratio or the pressure differential is unusually high such that the discharge pressure in chamber 77 becomes unusually high. This may occur even when the compressor is rotating in the forward direction. When the discharge pressure overcomes the opposing forces, then the valve moves to the open position such as shown in FIG. 4. One difference under these conditions, is that the valve 80 will be forced open, since the pressure in chamber 85 will exceed suction pressure.

Thus, even when the compressor is rotating in a forward direction, the same valve which reduces any detrimental effects from reverse rotation will also act to reduce detrimental effect from an unusually high pressure ratio or pressure differential.

A third embodiment valve 100 performs the pressure relief function of the second embodiment valve, but does not operate under reverse rotation. In embodiment 100, the fixed scroll 102 is shown somewhat schematically. An intermediate pressure chamber 104 communicates with a tap 106 leading to a chamber 108. A piston 110 moves within the chamber 108, and has a forward valve portion 112, which closes a tap 114 leading to a discharge pressure chamber 115. A tap 116 to a suction pressure chamber 117 communicates suction pressure to a face 118 of the piston 110, and into a chamber 120. A spring 122 is held against the plug 124 and biases piston 110 to the closed position such as shown in FIG. 5.

Figure 5:
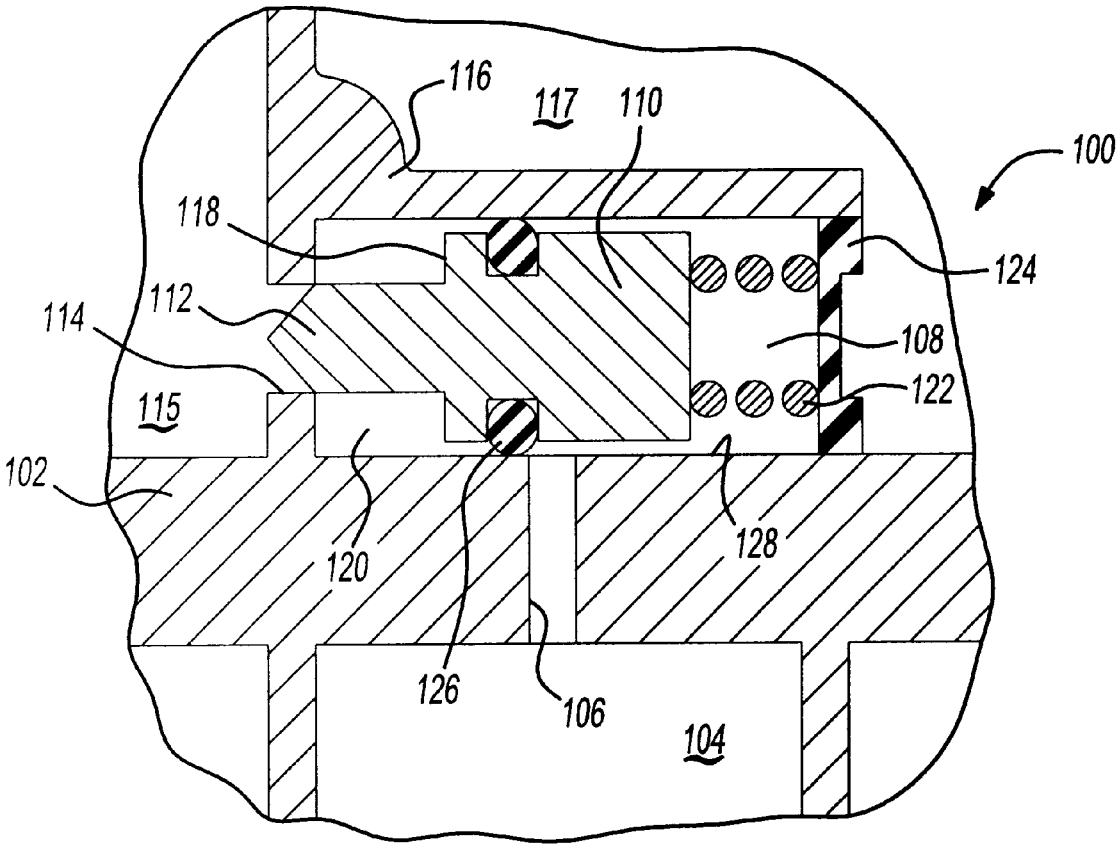
FIG. 5 shows a third embodiment valve.

As long as the pressure ratio or pressure differential is not too high, the piston will remain in the position shown in FIG. 5. However, as was the case with the second embodiment, should the pressure ratio or pressure differential get too high, then the pressure in chamber 115, and as applied to the face 112, will exceed the combined force of the spring 122, and the intermediate pressure force in chamber 108 on the piston 110. At that time, the piston will move to the right as shown in FIG. 5, and chamber 115 will communicate to chamber 117. Thus, this embodiment provides a very low cost method for providing pressure relief, and protecting the compressor. A seal 126 rides along an inner surface 128 of the fixed scroll to seal a chamber 120 from the chamber 108.

Known force balancing equations can be used to design the effective areas of the chambers, piston faces, and spring force to achieve desired operation of the value.

Preferred embodiments of this invention have been disclosed; however, a worker of ordinary skill in the art would recognize that certain modifications come within the scope of this invention. For that reason, the following claims should be studied to determine the true scope and content of this invention.

What is claimed is:

1. A scroll compressor comprising:

a first scroll member having a base and a generally spiral wrap extending from said base;

a second scroll member having a base and a generally spiral wrap interfitting with said scroll wrap of said first scroll member to define compression pockets;

a discharge port extending through said first scroll base to a discharge chamber;

a check valve selectively closing said discharge chamber;

a downstream location positioned downstream of said check valve; and a valve for selectively communicating said downstream location to a location upstream of said check valve, said valve being normally closed when said second scroll is moving in one direction, but said valve being opened when said second scroll moves in a second direction, said first direction being a normal forward direction for said scroll compressor, and said second direction being a reverse direction of said scroll compressor, a separator plate being spaced from said first scroll member, and a suction pressure chamber defined between a rear face of said base of said first scroll member and said separator plate, said valve having a valve surface exposed to said suction pressure on a first surface, and to said pressure in said discharge chamber on a second surface, said valve having a closure portion biased to a closed position by pressure in said discharge pressure chamber when said compressor is moving in said first direction, said closure portion being moved to an open position when said scroll compressor moves in said second direction such that refrigerant can pass from said downstream chamber into said discharge chamber when said compressor is rotating in said second direction.

2. A scroll compressor as recited in claim 1, wherein said closure portion of said valve is generally frusto-conically shaped.

3. A scroll compressor as recited in claim 2, wherein said valve includes a valve body including a tap communicating said discharge chamber with a chamber above a land on said valve.

4. A scroll compressor comprising:

a first scroll member having a base and a generally spiral wrap extending from said base;

a second scroll member having a base and a generally spiral wrap interfitting with said scroll wrap of said first scroll member to define compression pockets;

a discharge port extending through said first scroll base to a discharge chamber;

a check valve selectively closing said discharge chamber;

a downstream location positioned downstream of said check valve; and a valve for selectively communicating said downstream location to a location upstream of said check valve, said valve being normally closed when said second scroll is moving in one direction, but said valve being opened when said second scroll moves in a second direction, said first direction being a normal forward direction for said scroll compressor, and said second direction being a reverse direction of said scroll compressor, wherein said valve selectively communicates said downstream location to an intermediate chamber defined between said first and second scrolls.

5. A scroll compressor as recited in claim 4, wherein a valve housing body is positioned in a separator plate spaced from said base of said first scroll member, and said valve housing extending into said base of said first scroll member.

6. A scroll compressor as recited in claim 5, wherein a chamber between said separator plate and said first scroll base is maintained at suction pressure.

7. A scroll compressor as recited in claim 6, wherein a suction valve selectively communicates suction pressure into an interior of said valve housing body.

8. A scroll compressor as recited in claim 7, wherein a movable valve is positioned within said valve housing and selectively closes an opening from said downstream chamber to said intermediate chamber, and said suction pressure is communicated to a surface of said movable valve to bias said movable valve body in a direction to open said downstream chamber opening.

9. A scroll compressor as recited in claim 8, wherein a spring biases said movable valve body to a closed position.

10. A scroll compressor as recited in claim 9, wherein a second movable valve moves within said movable valve to open and close said communication between said downstream chamber and said intermediate chamber.

11. A scroll compressor as recited in claim 8, wherein said opening from said downstream chamber to said intermediate chamber also opens if discharge pressure exceeds a maximum, even when said second scroll is moving in said first direction.

12. A scroll compressor comprising:

a first scroll member having a base and a generally spiral wrap extending from said base;

an orbiting scroll member having a base and a generally spiral wrap interfitting with said scroll wrap of said first scroll member to define compression pockets;

a discharge port extending through said first scroll wrap base to a discharge chamber;

a check valve selectively closing said discharge chamber;

a downstream chamber positioned downstream of said check valve; and a valve housing with a first opening to said downstream chamber, a second opening to one of said compression chambers, and a third opening to a chamber exposed to suction pressure, a suction valve positioned within said third opening, and a first movable valve body selectively closing said first opening, a spring biasing said first movable valve to a closed position, and a second movable valve movable within said first movable valve, said third opening communicating suction pressure to a first surface of said first movable valve in opposition to a spring bias force, and said pressure from said compression chamber being exposed to an opposed surface of said first movable valve, said second movable valve seeing suction pressure on one face and pressure from said compression chamber on another face such that when said compressor is rotating in a first direction, pressure in said compression chamber and said spring force exceed a force from said suction pressure and the pressure in said downstream chamber such that said first movable valve and said second movable valve are maintained in a position to close communication between said downstream chamber and said compression chamber, however, when rotation in a reverse direction occurs, the pressure in said compression chamber drops below the suction and discharge pressure and the combined force of the suction and discharge pressure exceeds the compression chamber pressure force combined with the spring force such that said first and second movable valves move to an open position to allow flow from said discharge chamber to said compression chamber.

13. A scroll compressor as recited in claim 12, wherein the pressure in said downstream chamber is exposed to a relatively small surface area, and the pressure in said suction chamber is exposed to a relatively great surface area, and the pressure in said compression chamber is exposed to a surface area which approximates the total surface area exposed to said suction and said downstream chambers.

14. The scroll compressor as recited in claim 13, wherein when the pressure in said discharge chamber reaches such a high level that the combined force of the suction and discharge pressure on their respective areas exceeds the compression chamber pressure force combined with the spring force, said first and second moveable valves move to an open position even when said compressor is being rotated in said first direction.

* * * * *